United States Patent [19]

Barrett

[11] Patent Number: 4,867,869

[45] Date of Patent: Sep. 19, 1989

[54] GRATE MAGNET

[75] Inventor: William T. Barrett, Waukesha, Wis.

[73] Assignee: Venturedyne, Ltd., Milwaukee, Wis.

[21] Appl. No.: 128,148

[22] Filed: Dec. 3, 1987

[51] Int. Cl.[4] ..... B03C 1/10

[52] U.S. Cl. ..... 209/223.2; 209/228; 312/348; 403/109

[58] Field of Search ..... 209/223.1, 223.2, 228; 55/100; 210/222, 223; 312/348, 271; 403/109

[56] References Cited

U.S. PATENT DOCUMENTS

| | | | |
|---|---|---|---|
| 1,705,625 | 3/1929 | Mitchell | 403/109 |
| 1,953,387 | 4/1934 | Benjamin | 403/109 |
| 2,277,703 | 3/1942 | Kennedy et al. | 403/109 |
| 2,733,812 | 2/1956 | Hoff | 209/223.1 |
| 2,792,115 | 5/1957 | Medearis | 209/223.1 |
| 3,866,619 | 2/1975 | Per Frisk | 403/109 |
| 4,150,851 | 4/1979 | Cienfuegos | 403/109 |

FOREIGN PATENT DOCUMENTS

| | | | |
|---|---|---|---|
| 3307319 | 9/1984 | Fed. Rep. of Germany | 209/223.2 |
| 1283967 | 8/1972 | United Kingdom | 403/109 |

*Primary Examiner*—Andres Kashnikow
*Assistant Examiner*—Mark T. Le
*Attorney, Agent, or Firm*—Michael, Best & Friedrich

[57] ABSTRACT

A grate magnet apparatus comprising a frame defining an opening adapted to have material to be separated pass therethrough, a non-magnetic tube supported by the frame and extending across the opening, and an elongated magnetic member removably housed in the tube, whereby magnetic material is attracted to the tube when the magnetic member is housed in the tube and is released from the tube when the member is removed from the tube. The non-magnetic tubes and magnet members are connected both for joint movement to be withdrawn from the path of the flowing material and then for relative movement to release magnetic material from the non-magnetic tube.

13 Claims, 2 Drawing Sheets

GRATE MAGNET

BACKGROUND OF THE INVENTION

The invention relates to magnetic separation devices and, more particularly, to grate magnets.

A conventional grate magnet includes a frame defining an opening through which material to be separated passes. A plurality of elongated, usually cylindrical magnets extend across the opening so that magnetic material is attracted to the magnets while non-magnetic material is not. Typically, the magnets are mounted in a drawer-like frame that is slidably housed in a delivery duct or chute so that the magnets can be removed from the duct before magnetic material is removed from the magnets. Removal of magnetic material from the magnets can be difficult.

SUMMARY OF THE INVENTION

The invention provides a grate magnet apparatus in which the magnets of the prior art are replaced by non-magnetic tubes slidably housing elongated magnets. When the magnets are in the tubes, magnetic material is attracted to the exterior of the tubes. When the magnets are removed from the tubes, the magnetic material falls off the exterior of the tubes.

More particularly, the preferred embodiment of the invention is combined with a duct defining an opening into a chamber adapted to contain non-magnetic material, and a frame defines an opening in the duct through which material to be separated passes. The frame is removably housed within the duct with the opening in the frame aligned with the opening into the chamber. The apparatus also comprises a plurality, e.g. ten or twelve, of parallel, non-magnetic tubes supported by the frame and extending across the opening in the frame. Each of the tubes removably houses a respective elongated, cylindrical magnet.

As described above, the magnets can be pulled out of the tubes in order to remove magnetic material from the exterior of the tubes. In order to facilitate removal of the magnets from the tubes, the magnets are connected together so that they can be removed from their respective tubes simultaneously. This could present a problem in that, because it could be difficult to line up ten or more magnets with their respective tubes, and because the magnets are relatively heavy, it could be difficult to align all of the magnets with the ends of their respective tubes in order to reinsert the magnets into the tubes.

In order to eliminate this potential problem, the magnets are maintained in alignment with their respective tubes, preferably by having the tubes extend beyond the frame. In other words, each tube includes a first portion extending across the opening through which material passes, and a second portion extending beyond or outside of the opening. Preferably, the frame includes a wall which partially defines the opening in the frame, the first portion of each tube extends on one side of the wall, and the second portion of each tube extends on the other side of the wall. Since only the first portions of the tubes extend across the opening, magnetic material is attracted only to the first portions when the magnets are housed in the tubes. Therefore, it is only necessary to remove the magnets from the first portions of the tubes in order to remove magnetic material from the tubes. The ends of the magnets can remain housed in the second portions of the tubes while magnetic material is removed from the first portions, and the second portions of the tubes therefore maintain alignment of the magnets with the tubes and guide the magnets back into the tubes after magnetic material is removed from the first portions of the tubes.

When the magnets are withdrawn from the first portions of the tubes, magnetic material on the exterior of the tubes tends to follow the magnets toward the frame wall separating the first portions from the second portions. The frame wall separating the first and second tube portions acts as a scraper and causes magnetic material to fall off the exterior of the tubes when it hits the frame wall and the magnets are fully withdrawn from the first portions of the tubes.

In the preferred embodiment, the outer ends of the magnets are interconnected by a plate having thereon a handle for facilitating manual movement of the magnets. Preferably, a chain extends between the frame and the plate to prevent the magnets from being completely withdrawn from the tubes, i.e., from being pulled out of the second portions of the tubes.

Other features and advantages of the invention will become apparent to those skilled in the art upon review of the following detailed description, claims, and drawings.

Figure 1:
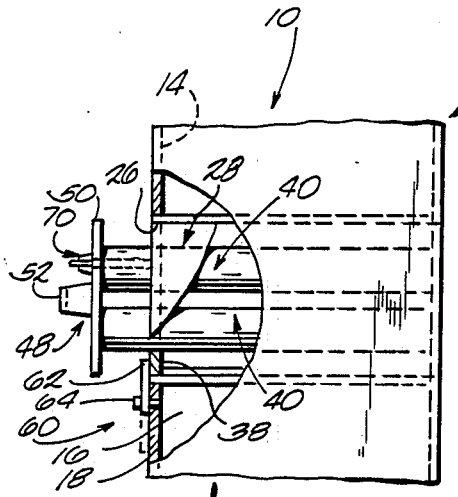
FIG. 1 is a partial, side elevational view of a grate magnet apparatus embodying the invention and comprising a duct, a frame slidably houses in the duct, a plurality of tubes supported by the frame, and a plurality of cylindrical magnets slidably housed by the tubes.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Figure 4:
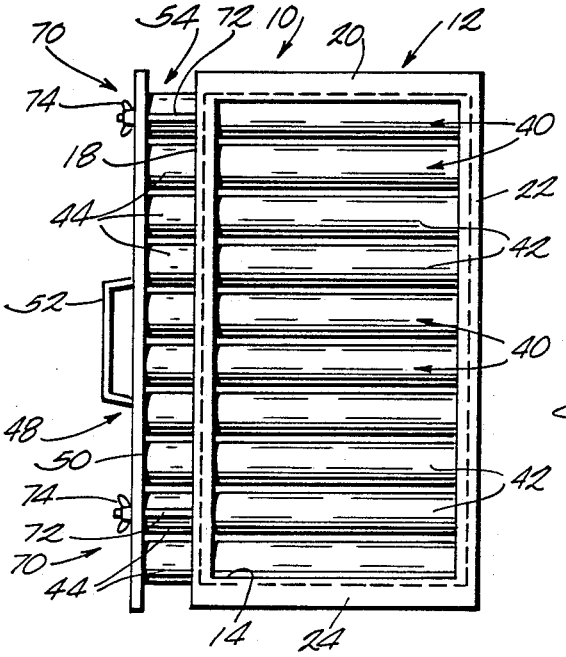
FIG. 4 is a top view of the apparatus.
Figure 5:
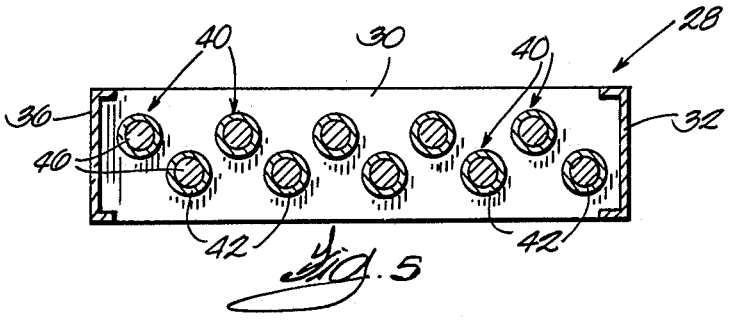
FIG. 5 is a view taken along line 5—5 in FIG. 2.

A grate magnet apparatus 10 embodying the invention is illustrated in the drawings. As shown in FIGS. 1 and 4, the apparatus 10 comprises a generally rectangular duct 12 defining an opening 14 into a chamber 16 adapted to contain non-magnetic material. The chamber 16 can be enclosed within the duct 12 or can simply communicate with a container (not shown) for non-magnetic material. As shown in FIG. 4, the duct 12 includes two pairs of generally perpendicular walls 18, 20, 22 and 24. The wall 18 of the duct 12 has therein a rectangular opening 26 (see FIG. 1).

Figure 2:
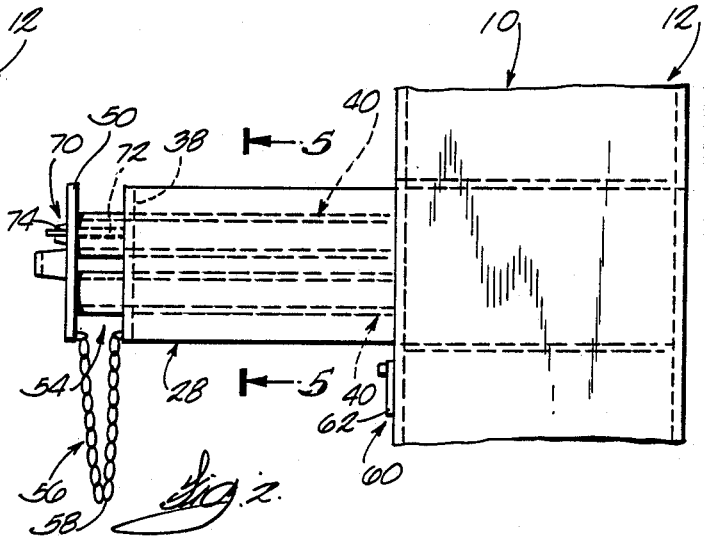
FIG. 2 is a view similar to FIG. 1 and showing the frame removed from the housing.
Figure 3:
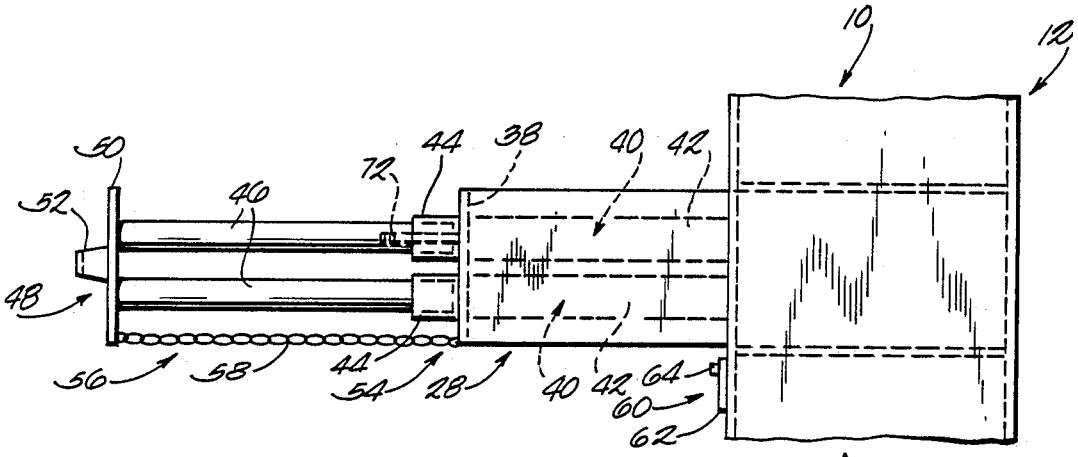
FIG. 3 is a view similar to FIG. 2 and showing the magnets removed from the tubes.
Figure 6:
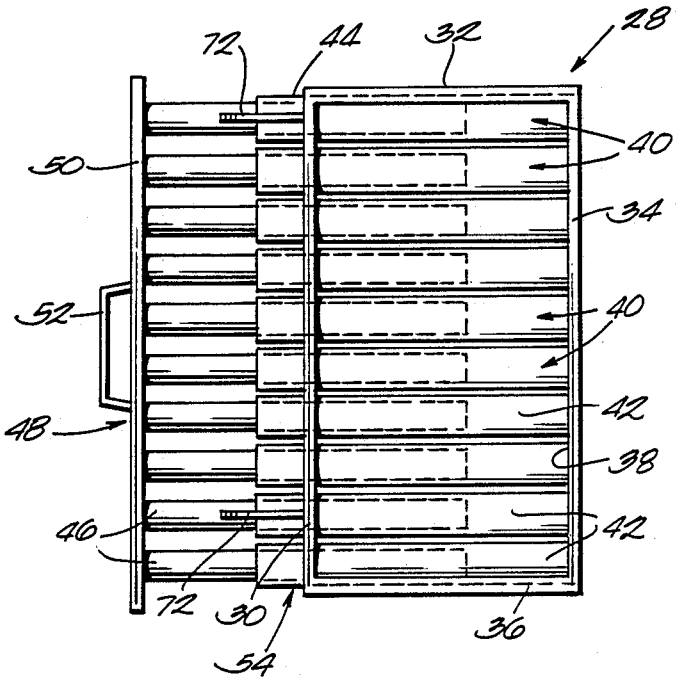
FIG. 6 is a top view of the frame and showing the magnets partially removed from the tubes.

The apparatus 10 also comprises a generally rectangular, drawer-like frame 28. As best shown in FIG. 6, the frame 28 includes two pairs of generally perpendicular walls 30, 32, 34 and 36 and defines an opening 38 through which material intended to undergo the separation process passes. The frame 28 extends through the opening 26 in the duct wall 18 and is slidably and removably housed by the duct 12 with the opening 38 in the frame 28 aligned with the opening 14 in the duct 12, so that material passing through the opening 14 in the duct 12 also passes through the opening 38 in the frame 28 and into the chamber 16. When the frame 28 is pulled out of the duct 12, as shown in FIGS. 2 and 3, the frame opening 38 does not overlap with the duct opening 14.

A plurality of generally parallel tubes 40 are supported by the frame 28 and extend across the frame opening 38. These tubes are made of a non-magnetic material such as stainless steel. Preferably, the tubes 40 extend through the frame wall 30 and each tube 40 includes a first portion 42 extending on one side of the frame wall 30 and across the frame opening 38, and a second portion 44 extending on the other side of the frame wall 30 and thus beyond the frame opening 38.

Each tube 40 removably houses a respective elongated, cylindrical magnetic member or magnet 46. When the members 46 are fully inserted into the tubes 40 and the frame 28 is fully inserted into the duct 12, magnetic material passing through the duct 12 is attracted only to the exterior of the first portions 42 of the tubes 40. When the members 46 are removed from the tubes 40, i.e., at least from the first portions 42 of the tubes 40, magnetic material is released from the exterior of the tubes 40.

Means 48 connnects the members 46 for common movement of the members 46 axially of the tubes 40 in response to movement of the connecting means 48. While various suitable connecting means 48 can be employed, in the preferred embodiment, the connecting means 48 includes a plate 50 fixedly connected to the ends of the members 46. As illustrated in the drawings, the plate 50 has thereon a handle 52 for facilitating manual movement of the members 46.

Means 54 maintains alignment of the members 46 with the tubes 40 and guides the members 46 into the tubes 40 after the members 46 are withdrawn from the tubes 40, i.e., from the first Portions 42 of the tubes 40. While various suitable aligning and guiding means 54 can be used, in the illustrated construction, such means 54 includes the second portions 44 of the tubes 40. As explained above, magnetic material is attracted only to the first portions 42 of the tubes 40 when the magnets or members 46 are fully inserted into the tubes 40. Therefore, it is only necessary to withdraw the magnets 46 from the first portions 42 of the tubes 40 in order to remove magnetic material from the exterior of the tubes 40. Accordingly, the ends of the magnets 46 can remain housed in the second portions 44 of the tubes 40, as shown in FIG. 3, so that the magnets 46 remain aligned with their respective tubes 40.

In the preferred embodiment, means 56 is also provided for preventing removal of the magnets 46 from the second portions 44 of the tubes 40. While various suitable preventing means 56 can be employed, in the preferred embodiment, such means 56 includes a chain 58 extending between the frame 28 and the plate 50. The length of chain 58 is such that it prevents complete withdrawal of magnets 46 from portions 44.

Preferably, means 60 is provided for locking the frame 28 within the duct 12, i.e., in the position shown in FIGS. 1 and 4. While various suitable locking means can be employed, in the preferred embodiment, such means 60 includes a member 62 (see FIG. 1) which is pivotally mounted on the wall 18 of the duct 12 by a bolt 64 and which is pivotally movable between a locked position (shown in solid lines in FIG. 1) wherein the member 62 overlaps the frame 28 and prevents withdrawal of the frame 28 from the duct 12 and an unlocked position (shown in dotted lines in FIG. 1) wherein the member 62 permits withdrawal of the frame 28 from the duct 12.

Means 70 is also provided for securing the plate 50 to the frame 28 so that the entire assembly of the plate 50, the frame 28, the tubes 40 and the magnetic members 46 can be withdrawn from the duct 12 by pulling on the handle 52. While various suitable means can be used, in the illustrated construction, such means 70 includes a pair of studs 72 extending outwardly from the frame wall 30 and through aligned apertures (not shown) in the plate 50. The means 70 also includes wing nuts 74 removably threaded onto the studs 72. When the members 46 are fully inserted into the tubes 40, the studs extend through the apertures in the plate 50, and the wing nuts 74 are threaded onto the studs 72 to prevent movement of the plate 50 relative to the frame 28. When the handle 52 is pulled away from the duct 12 with the wing nuts 74 threaded onto the studs 72, the frame 28 is withdrawn from the duct 12. After the wing nuts 74 are removed from the studs 72, pulling on the handle 52 causes the plate 50 to move away from the frame 28 and withdraws the members 46 from the tubes 40.

The apparatus operates as follows. When the frame 28 is fully housed in the duct 12 and the magnets 46 are fully housed in the tubes 40, as shown in FIG. 1, material passing through the duct 12 passes over the exterior of the first portions 42 of the tubes 40. Magnetic material is attracted to the exterior of the first portions 42 of the tubes 40, while non-magnetic material is allowed to pass into the chamber 16. In order to remove magnetic material from the exterior of the tubes 40, the frame 28 is first removed from the duct 12, as shown in FIG. 2. Next, the magnets 46 are withdrawn from the first portions 42 of the tubes 40, as shown in FIG. 3.

Figure 7:
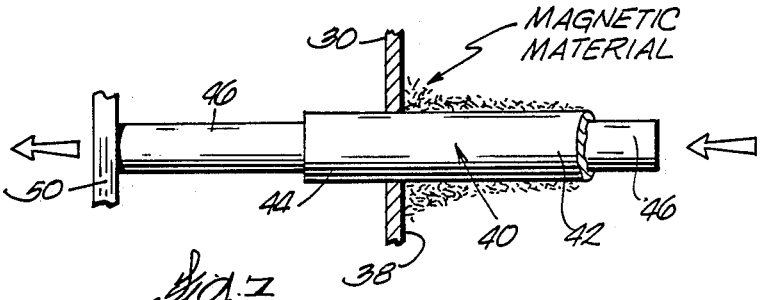
FIG. 7 is an enlarged, partial top view of the frame, a tube, and a magnet being withdrawn from the tube.

As can be seen in the drawings, the movement of the frame relative to the duct and then the movement of the magnets relative to the frame is in the same direction along the same path of movement relative to the duct. As the magnets 46 are withdrawn from the tubes 40, as shown in FIG. 7, magnetic material on the exterior of the tubes 40 follows the magnets 46 along the exterior of the tubes 40. The frame wall 30 acts as a scraper and a barrier preventing the magnetic material from following the magnets 46 and causing the magnetic material to fall off the exterior of the tubes 40. Any magnetic material remaining on the exterior of the tubes 40 can be easily brushed off, since it is not magnetically attracted to the tubes 40.

Various features of the invention are set forth in the following claims.

What is claimed is:

1. A grate magnet apparatus comprising a frame defining an opening adapted to have material to be separated pass therethrough, a non-magnetic, elongated tube supported by said frame and extending across said opening, means supporting said frame for movement along a path extending in a first direction, an elongated magnetic member housed in said tube, means connecting said elongated magnetic member to said frame for selective movement with said frame along said path in said first direction and selective movement relative to said frame also in said first direction of movement so that one increment of movement in said first direction of movement moves said magnetic members jointly with said tubes and continued movement through another increment of movement in said first direction moves said magnetic members relative to said tubes, and collapsible restraining means connected to said elongated magnetic member for limiting the movement of said magnetic member relative to said tube to prevent withdrawal of said elongated magnetic member from said tube, whereby magnetic material is attracted to said tube when said member is housed in said tube and is released from said tube when said member is removed from said tube.

2. A grate magnet apparatus comprising a frame defining an opening adapted to have material to be separated pass therethrough, first and second generally parallel, non-magnetic tubes supported by said frame and extending across said opening, means supporting said frame for movement along a path extending in a first direction, first and second elongated, magnetic members removably housed in said first and second tubes, respectively, whereby magnetic material is attracted to said tubes when said members are housed in said tubes and is released from said tubes when said members are removed from said tubes, and means connecting said members to said frame for selective movement with said frame in said first direction and for selective common movement of said members axially of said tubes also in said first direction of movement so that one increment of movement in said first direction of movement moves said magnetic members jointly with said tubes and continued movement through another increment of movement in said first direction moves said magnetic members relative to said tubes, and collapsible restraining means connected to said elongated magnetic member for limiting the movement of said magnetic member relative to said tube to prevent withdrawal of said elongated magnetic member from said tube.

3. An apparatus as set forth in claim 2 and further comprising duct means defining an opening into a chamber adapted to contain non-magnetic material, and wherein said frame is removably housed by said duct means with said opening in said frame aligned with said opening in said duct means, and said frame can be removed from said duct means before magnetic material is removed from said tubes so that magnetic material is prevented from entering said chamber.

4. A grate magnetic apparatus comprising a frame defining an opening adapted to have material to be separated pass therethrough, first and second generally parallel, non-magnetic tubes supported by said frame and including respective first portions extending across said opening and respective second portions extending beyond said opening, means supporting said frame for movement along a path extending in a first direction, first and second elongated, magnetic members removably housed in said first and second tubes, respectively, whereby magnetic material is attracted to said tubes when said members are housed in said tubes and is released from said tubes when said members are removed from said tubes, and means connecting said members to said frame for selective movement with said frame in said first direction and for selective common movement of said members axially of said tubes also in said first direction of movement so that magnetic material is attracted to said first portions when said members are housed in said tubes and so that magnetic material can be removed from said first portions by removing said members from said first portions and leaving said members in said second portions, and means for maintaining alignment of said members with said tubes and for guiding said members into said tubes after said members are withdrawn from said tubes, said aligning and guiding means including said second portions.

5. An apparatus as set forth in claim 4 and further comprising means for preventing removal of said members from said second portions.

6. An apparatus as set forth in claim 5 wherein said preventing means includes a chain extending between said frame and said connecting means.

7. An apparatus as set forth in claim 4 wherein said frame includes a wall having opposite first and second sides, said first side defining one side of said opening, wherein said first portions of said tubes extend on said first side of said wall, and wherein said second portions of said tubes extend on said second side of said wall.

8. A grate magnet apparatus comprising a frame defining an opening adapted to have material to be separated pass therethrough, a non-magnetic, elongated tube supported by said frame and including a first portion extending across said opening and a second portion extending beyond said opening, means supporting said frame for movement along a path extending in a first direction, an elongated magnetic member housed in said tube, means connecting said elongated magnetic member to said frame for selective movement with said frame along said path in said first direction and selective movement relative to said frame also in said first direction of movement so that magnetic material is attracted to said first portion when said member is housed in said tube and so that magnetic material can be removed from said first portion by removing said member from said first portion and leaving said member in said second portion, alignment means including said second portion of said tube and operative to maintain alignment of said member with said tube and for guiding said member into said tube after said member is withdrawn from said tube.

9. A grate magnet apparatus comprising duct means defining an opening into a chamber adapted to contain non-magnetic material, a frame defining an opening through which material to be separated passes, means supporting said frame for movement relative to said duct means between positions wherein said frame opening is aligned with said opening in said duct means and removed from said opening in said duct means, first and second generally parallel, non-magnetic tubes supported by said frame and extending across said opening in said frame with the longitudinal axis thereof extending parallel to the path of movement of said frame relative to said duct means, said tubes including respective first portions extending across said opening in said frame and respective second portions extending beyond said opening in said frame, first and second elongated, magnetic members housed in said first and second tubes, respectively, for movement relative thereto, means connecting said members for causing common movement of said members axially of said tubes in response to movement of said connecting means, and means for preventing removal of said members from said second portions.

10. An apparatus as set forth in claim 9 wherein said preventing means includes a chain extending between said frame and said connecting means.

11. An apparatus as set forth in claim 9 wherein said frame includes a wall having opposite first and second sides, said first side defining one side of said opening, wherein said first portions of said tubes extend on said first side of said wall, and wherein said second portions of said tubes extend on said second side of said wall.

12. A grate magnet for use in combination with a duct through which material containing magnetic and non-magnetic portions can be made to flow, said grate magnet comprising, in combination, means defining an open frame, a plurality of elongated, hollow tubes extending transversely of said frame in parallel relationship to each other, said tubes being made of non-magnetic material, means connecting said tubes and frame for joint movement, a plurality of elongated, magnetic members, support means supporting said magnetic members with said magnetic members being positioned in respective tubes and for relative movement of said magnetic members in their respective tubes, said support means further supporting said magnetic members for joint movement with their respective tubes, whereby said magnetic members can be positioned within said tubes and within said open frame and said magnetic members and tubes can be selectively moved as unit relative to a duct and said magnetic members can be selectively withdrawn from said tubes when desired and wherein said tubes each have a first section contained within said open frame and a second section projecting laterally from said open frame so that said magnetic members can be withdrawn from the interior of said open frame but remain engaged in said second tube sections.

13. The grate magnet of claim 1 wherein said tubes and frame are supported for movement along a path extending in a first direction and said magnetic members are supported for movement relative to said frame and tubes in a direction parallel to said path.

* * * * *

UNITED STATES PATENT AND TRADEMARK OFFICE

CERTIFICATE OF CORRECTION

PATENT NO. : 4,867,869

DATED : September 19, 1989

INVENTOR(S) : William T. Barrett

It is certified that error appears in the above-identified patent and that said Letters Patent is hereby corrected as shown below:

Column 8, line 27, change "1" to --12--.

Signed and Sealed this

Second Day of October, 1990

*Attest:*

HARRY F. MANBECK, JR.

*Attesting Officer*

*Commissioner of Patents and Trademarks*